US007392821B2

(12) United States Patent
Nakata et al.

(10) Patent No.: US 7,392,821 B2
(45) Date of Patent: Jul. 1, 2008

(54) DRAIN WATER DISCHARGE STRUCTURE FOR AIR CONDITIONER

(75) Inventors: Haruo Nakata, Osaka (JP); Kazuhide Mizutani, Osaka (JP); Hiromune Matsuoka, Osaka (JP); Makio Takeuchi, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 19 days.

(21) Appl. No.: 10/526,934

(22) PCT Filed: Oct. 28, 2003

(86) PCT No.: PCT/JP03/13803

§ 371 (c)(1),
(2), (4) Date: Mar. 8, 2005

(87) PCT Pub. No.: WO2004/040201

PCT Pub. Date: May 13, 2004

(65) Prior Publication Data

US 2006/0070658 A1 Apr. 6, 2006

(30) Foreign Application Priority Data

Oct. 29, 2002 (JP) ..... 2002-314047

(51) Int. Cl.
*F16K 23/00* (2006.01)

(52) U.S. Cl. ..... 137/312; 137/565.01; 220/571

(58) Field of Classification Search ..... 137/312, 137/565.01; 62/903, 434, 324.1; 220/571
See application file for complete search history.

(56) References Cited

U.S. PATENT DOCUMENTS 2,913,227 A * 11/1959 Bottorf et al. ..... 165/123
3,802,218 A * 4/1974 Yoshiro ..... 62/324.1
4,869,075 A * 9/1989 Ikari et al. ..... 62/280
6,012,708 A * 1/2000 Nagano ..... 261/109
6,189,338 B1 * 2/2001 Lehman ..... 62/643
6,247,324 B1 * 6/2001 Hsu ..... 62/285
6,487,867 B1 * 12/2002 Herren ..... 62/150

FOREIGN PATENT DOCUMENTS

| | | | |
|---|---|---|---|
| CN | 1052546 A | | 6/1991 |
| CN | 2443279 Y | | 8/2001 |
| JP | 4-366327 A | | 12/1992 |
| JP | 05-157270 | | 6/1993 |
| JP | 06-046214 | | 2/1994 |
| JP | 06-193582 | | 7/1994 |
| JP | 6-257776 A | | 9/1994 |
| JP | 07-022101 | | 1/1995 |
| JP | 07-305796 | | 11/1995 |
| JP | 10-078240 A | | 3/1998 |
| JP | 10-202267 A | * | 8/1998 |
| JP | 2000-97447 A | | 4/2000 |

(Continued)

*Primary Examiner*—Kevin Lee
(74) *Attorney, Agent, or Firm*—Birch, Stewart, Kolasch & Birch, LLP

(57) ABSTRACT

Disclosed is a drain water discharge structure for an air conditioning apparatus in which at least any one of an internal drain pipe (12) and an external drain pipe (14) is formed from an antibacterial metal pipe, thereby to inhibit the generation of slime in the external drain pipe (14) and to make the external drain pipe (14) less apt to deterioration.

4 Claims, 1 Drawing Sheet

FOREIGN PATENT DOCUMENTS

| | | | | |
|---|---|---|---|---|
| JP | 2001-235174 | A | | 8/2001 |
| JP | 2002-021776 | | | 1/2002 |
| JP | 2002-303430 | A | | 10/2002 |
| JP | 2003-222273 | A | * | 8/2003 |
| KR | 2001-0058211 | | | 7/2001 |

* cited by examiner

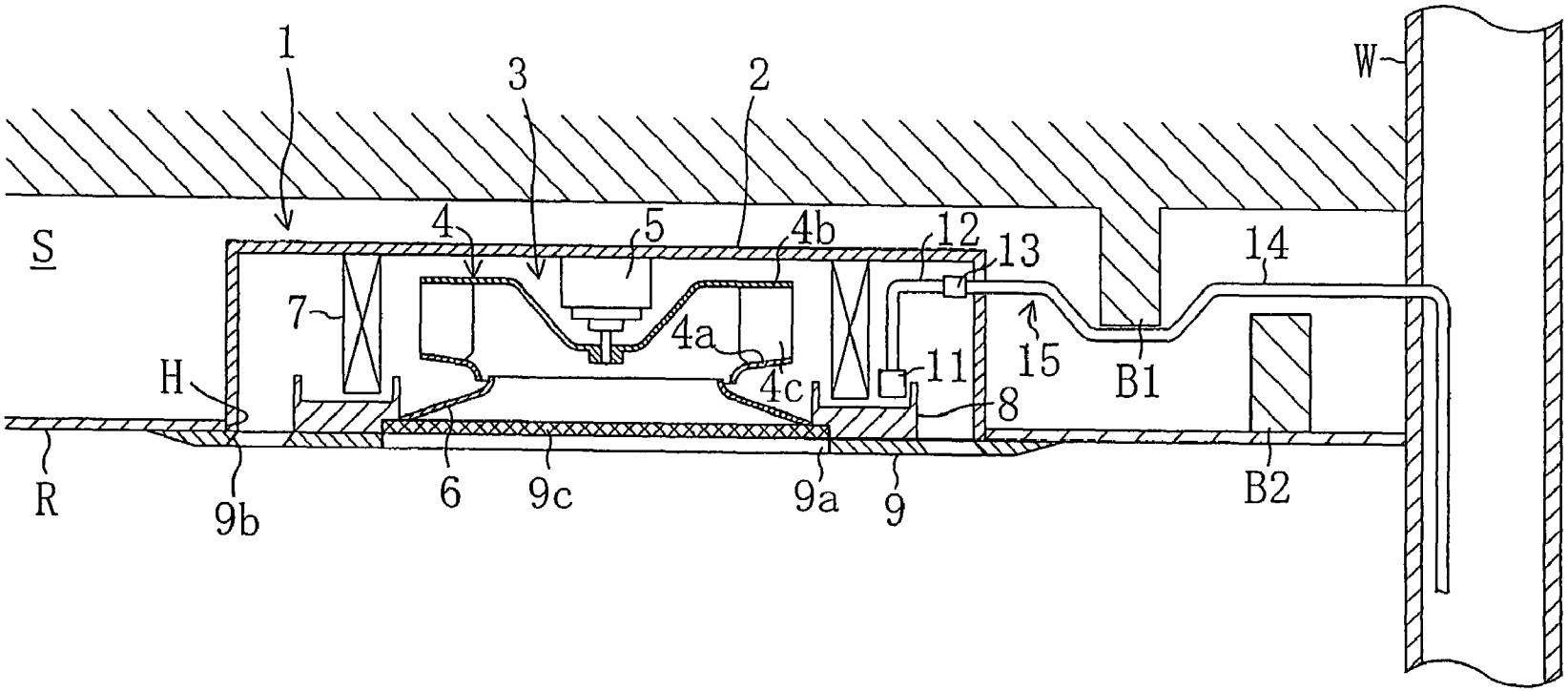
W
14
B2
B1
15
13
12
11
8
9
9a
4b
4c
2
4a
5
3
9c
4
6
7
1
9b
H
S
R

DRAIN WATER DISCHARGE STRUCTURE FOR AIR CONDITIONER

TECHNICAL FIELD

The present invention relates to a drain water discharge structure for an air conditioning apparatus.

BACKGROUND ART

In one type of conventional air conditioning apparatus known in the art, drain water, generated in an indoor heat exchanger during performing of a cooling or dehumidification mode of operation, is discharged outside after sterilization. The reason for this is given as follows. Drain water condensed when cooled in the indoor heat exchanger contains various bacteria in the air. Accordingly, in the absence of a sterilization treatment, there is the possibility that when drain water is accumulated in a drain pan or drain pipe the generation of slime is caused to take place by the growth of bacteria contained in the accumulated drain water. Slime is the semi-solid substance, and the generation of slime taking place in pipes, as the drain pipe, gives rise to several drawbacks including the occurrence of water leakage by pipe clogging and the generation of unpleasant odor by decay of accumulated substances.

Concrete examples of air conditioning apparatuses of the drain water sterilization type are known. One such technique, as proposed in JP Pat. Kokai Publication No. 1992-366327 and JP Pat. Kokai Publication No. 1994-257776, uses, as an external drain pipe, a drain tube formed of an antibacterial agent-containing synthetic resin material. In accordance with the techniques as set forth in these official gazettes, drain water flowing in the drain tube is treated with the antibacterial agent contained in the synthetic resin material, thereby to prevent the accumulated drain water from becoming slimed.

Problems to be Solved

Incidentally, the problem with using a soft synthetic resin tube as a drain pipe is that the tube is liable to aged-deterioration. Especially when the tube becomes clogged to cause decay of accumulated substances, the deterioration of the tube tends to be accelerated. This may also be the problem with the case where a resinous pipe harder than the resin tube is used as an external drain pipe.

In the light of these problems with the prior art techniques, the present invention was made. Accordingly, an object of the present invention is to provide an improved water drain discharge structure for an air conditioning apparatus, thereby to prevent the generation of slime in a drain pipe and to make the drain pipe less liable to deterioration.

DISCLOSURE OF INVENTION

The present invention uses, as a drain pipe material, an antibacterial metal material such as copper instead of the synthetic resin material.

More specifically, a first invention is directed to a drain water discharge structure for an air conditioning apparatus (1) configured so as to discharge drain water generated in an indoor heat exchanger (7) disposed within a casing (2) of the air conditioning apparatus (1) to outside the room through a drain discharge pipe (15) made up of an internal drain pipe (12) and an external drain pipe (14). The first invention is characterized in that at least any one of the internal and external drain pipes (12) and (14) is formed from an antibacterial metal pipe.

The antibacterial metal pipe is capable of eluting, upon contact with water, antibacterial metal ions to the water.

In the first invention, drain water generated in the indoor heat exchanger (7) during the cooling or dehumidification mode of operation is discharged, through the drain discharge pipe (15), to outside the room. At least any one of the internal and external drain pipes (12) and (14) which together constitute the drain discharge pipe (15) is formed from an antibacterial metal pipe. As a result of such arrangement, when the drain water flows through the drain discharge pipe (15) antibacterial metal ions are eluted to the drain water from the antibacterial metal pipe. The antibacterial metal ions have the action to sterilize bacteria, in other words the drain water is sterilized in the drain discharge pipe (15). Accordingly, even when the drain water is accumulated in the drain discharge pipe (15), the generation of slime is inhibited, thereby preventing the occurrence of water leakage and the generation of unpleasant odor.

Furthermore, a second invention according to the drain water discharge structure of the first invention is characterized in that both the internal drain pipe (12) and the external drain pipe (14) are formed from antibacterial metal pipes.

In the second invention, each of the internal drain pipe (12) and the external drain pipe (14) is formed from an antibacterial metal pipe, thereby enhancing the action to sterilize drain water. This accordingly ensures that the generation of slime, the occurrence of water leakage and the generation of unpleasant odor are prevented.

Furthermore, a third invention according to the drain water discharge structure of the first invention further comprises a drain pan (8) disposed so as to receive drain water under the indoor heat exchanger (7), and a drain pump (11) operable to send out drain water collected in the drain pan (8) to the drain discharge pipe (15), and is characterized in that the drain pump (11) is formed by a force feed type pump.

Conventionally it is arranged such that drain water generated in the indoor heat exchanger is forced out of the drain pan by means of a splash type drain pump and is discharged, through a sloping external drain pipe, to outside the room. Stated another way, the head of drain water has conventionally been utilized for drainage. This therefore produces the problem with air conditioning apparatuses of the ceiling embedded type. That is, if an external drain pipe is either incurvated or inflected to avoid beams arranged under the roof, this creates a trap in the external drain pipe. As a result, drain water is liable to be accumulated in the trap, therefore producing the problem that drainage becomes difficult to carry out. On the other hand, the third invention employs, as the drain pump (11), a force feed type pump of high lift instead of a splash type pump of low lift. Accordingly, even in the case where there is created a trap in the external drain pipe (14), drain water is less apt to be accumulated in the trap and it becomes possible to prevent inconveniences for the discharging of drain water. Accordingly, combined with the use of an antibacterial metal pipe as the drain discharge pipe (15), slime is much less apt to be generated.

Additionally, a fourth invention according to the drain water discharge structure of the third invention is characterized in that the external drain pipe (14) is formed from an antibacterial metal pipe with an internal diameter of 12.7 millimeters or less.

In the case where the external drain pipe (14) is small in internal diameter, it is difficult to discharge drain water by a head due to pressure loss, even when the external drain pipe (14) is sloped. To cope with this, the external drain pipe (14) is conventionally generally formed from a pipe with a great diameter of about 20 to about 30 millimeters. On the other hand, the drain pump (11) of the fourth invention is a force feed type pump less subject to pressure loss. Accordingly, even the external drain pipe (14) with an internal diameter of 12.7 millimeters or less is able to discharge drain water therethrough without any clogging.

Additionally, a fifth invention according to the drain water discharge structure of any one of the first to fourth inventions is characterized in that the antibacterial metal pipe is a copper pipe.

In the fifth invention, the antibacterial metal pipe is formed from a copper pipe to sterilize drain water by copper ion, thereby ensuring that the generation of slime, the occurrence of water leakage and the generation of unpleasant odor are prevented.

Additionally, a sixth invention according to the drain water discharge structure of any one of the first to fourth inventions is characterized in that the air conditioning apparatus (1) is of the high installed type. The air conditioning apparatus (1) of the high installed type means an indoor unit of the type for ceiling embedded installation, ceiling suspended installation etc.

In the sixth invention, drain water is sterilized by the antibacterial metal pipe when discharged from the internal drain pipe (12) via the external drain pipe (14) arranged under the roof or the like. For example, in the case where the antibacterial metal pipe is formed from a copper pipe, the drain water is sterilized by copper ions eluted from the copper pipe when discharged via the external drain pipe (14).

Effects

Since the drain water discharge structure of the air conditioning apparatus in accordance with the first invention employs an antibacterial metal pipe as the drain discharge pipe (15), drain water generated in the indoor heat exchanger (7) during the cooling or dehumidification mode of operation is sterilized with antibacterial metal ions when discharged through the drain discharge pipe (15) to outside the room. Thereby, the generation of slime in the external drain pipe (14) is inhibited, therefore preventing the occurrence of water leakage and the generation of unpleasant odor.

In addition, the arrangement that the drain discharge pipe (15) is formed from an antibacterial metal pipe offers the advantage that the drain discharge pipe (15) is less apt to aged deterioration than is a resinous tube.

Furthermore, in accordance with the second invention, both the internal drain pipe (12) and the external drain pipe (14) are antibacterial metal pipes. Accordingly, the action to sterilize drain water is enhanced, thereby ensuring the prevention of slime generation, water leakage occurrence and unpleasant odor generation.

Additionally, in accordance with the third invention, the drain pump (11) is a force feed type pump. Therefore, even when there is created a trap in the external drain pipe (14), water is less liable to be accumulated there, and the generation of slime is less liable to occur. This accordingly ensures that problems such as water leakage are prevented.

Furthermore, in accordance with the fourth invention, the external drain pipe (14) with an internal diameter of 12.7 millimeters or less is used. However, since the drain pump (11) is of the force feed type, this allows drain water to be discharged through the external drain pipe (14) without any clogging. In addition, in the case where drain water is discharged to outside the room by a head, it is required to increase the pipe diameter. This produces the problem that manufacture costs increase if antibacterial metal pipes are used. However, even when antibacterial metal pipes are employed such a cost rise is prevented as long as their internal diameter does not exceed 12.7 millimeters. Furthermore, as the pipe diameter increases, the amount of drain water being accumulated increases and, as a result, the bactericidal effect tends to fall. On the contrary, as the pipe diameter decreases, the amount of drain water being accumulated decreases and, as a result, the bactericidal effect is improved.

In addition, in accordance with the fifth invention, a copper pipe is used as the antibacterial metal pipe, thereby making it possible to sterilize drain water with copper ions. Especially, if the external drain pipe (14) is formed from a copper pipe, this renders the work of pipe arrangement easier to carry out than when the external drain pipe (14) is formed from a hard resinous pipe because copper pipes are capable of being bent easily at the job site. Accordingly, in the case where the external drain pipe (14) is formed from a copper pipe, the deterioration prevention of the drain discharge pipe (15) and the workability of pipe arrangement are compatible.

Finally, in accordance with the sixth invention, when in the air conditioning apparatus (1) of the high installed type drain water is discharged through the internal drain pipe (12) and through the external drain pipe (14) arranged under the roof, the drain water is sterilized with antibacterial metal ions. As a result of such arrangement, it is possible to effectively prevent the generation of slime in the external drain pipe (14) and, in addition, the deterioration prevention of the external drain pipe (14) and the workability of pipe arrangement are compatible.

BRIEF DESCRIPTION OF DRAWING

The FIGURE is a sectional view showing a drain water discharge structure for an air conditioning apparatus according to an embodiment of the present invention.

BEST MODE FOR CARRYING OUT INVENTION

Exemplary embodiments of the present invention are described below in detail with reference to the drawing.

Referring to The FIGURE, there is shown in cross section a drain water discharge structure for an air conditioning apparatus according to an embodiment of the present invention. The drain water discharge structure of the present embodiment is as a result of applying the present invention to a ceiling embedded type air conditioning apparatus (1) as a high installed type. The air conditioning apparatus (1) is set in an opening (H) formed through a roof (R). A casing (2) of the air conditioning apparatus (1), which opens downward, is installed in a space (S) defined under the roof.

A turbofan (3) is disposed centrally in the casing (2). The turbofan (3) is made up of an impeller (4), a fan motor (5) and a bell-mouse (6). The impeller (4) includes a shroud (4*a*) and a hub (4*b*) between which is held a blade (4*c*), and a central part of the hub (4*b*) is directly connected to a driving shaft lower end part of the fan motor (5). The fan motor (5) is firmly fixed to a central part of the casing (2). The turbofan (3) is configured so as to radially outwardly send out a stream of air drawn from below by the rotation of the blade (4*c*) associated with the driving of the fan motor (5). The bell-mouse (6) is disposed under the impeller (4) of the turbofan (3) so that indoor air is guided to the impeller (4).

An indoor heat exchanger (7) is disposed around the impeller (4) of the turbofan (3). The indoor heat exchanger (7) is connected, via a refrigerant pipe, to an outdoor unit (not shown). The indoor heat exchanger (7) functions as an evaporator during the cooling mode of operation and as a condenser during the heating mode of operation. The indoor heat exchanger (7) controls the temperature and humidity of air blown out from the turbofan (3). In addition, disposed under the indoor heat exchanger (7) is a drain pan (8) for collection of drain water generated in the indoor heat exchanger (7) during the cooling or dehumidification mode of operation.

The casing (2) accommodates therein a drain pump (11) operable to discharge drain water accumulated in the drain pan (8) to outside the room. The drain pump (11) is of the force feed type such as a centrifugal pump. Unlike conventional drain pumps in which drain water splashed up from a drain pan is made to flow by a head, the drain pump (11) is of the high-lift type. The drain pump (11) is so configured as to become activated when a predetermined amount of drain water is accumulated in the drain pan (8) by means of a drain switch (not shown) which turns on when the water level of drain water in the drain pan (8) rises to a certain high level.

An internal drain pipe (12) extending upwardly in a substantially vertical direction is connected to the drain pump (11). The internal drain pipe (12) is formed from a copper pipe. The internal drain pipe (12) is bent towards a side plate near a top plate of the casing (2) and is connected, via a check valve (13), to one end of an external drain pipe (14). Thereby, the backflow of drain water to the drain pump (11) is prevented. The internal drain pipe (12) and the external drain pipe (14) together constitute a drain discharge pipe (15) of the air conditioning apparatus (1).

The external drain pipe (14) is formed from a coated copper pipe with an internal diameter of 12.7 millimeters. The copper pipe is coated with a thermal insulating material. Such a type of coated copper pipe is used also for refrigerant pipes. The external drain pipe (14) is arranged so as to extend, in the space (S) under the roof, towards a wall surface (W) of the building. The other end side of the external drain pipe (14) extends downwardly along the building wall surface (W) and its end is connected to a drain collective pipe (not shown). Also connected to the drain collective pipe are external drain pipes (14) of other air conditioning apparatuses (1) installed in the building or the like. Furthermore, within the space (S) under the roof, the aforesaid external drain pipe (14) is arranged in such a curved manner so as to avoid beams (B1, B2). Referring to the example shown in the FIGURE, a portion of the external drain pipe (14) that is bent downwardly so as to avoid the beam (B1) becomes a trap.

On the other hand, a face panel (9) shaped like a rectangle in plan view is mounted on a lower end part of the casing (2). An air suction opening (9*a*), i.e., a rectangle-like opening, is formed centrally in the face panel (2). In addition, a plurality of air blow-off openings (9*a*, 9*a*, . . . ) (for example, four air blow-off openings) are formed through side edge areas of the face panel (9) so as to be associated with respective sides of the face panel (2). An air filter (9*c*) for removing dust present in the air drawn through the air suction openings (9*a*) is provided in the air suction opening (9*a*), and a suction grill (not shown) is provided below the air filter (9*c*).

Operating Performance

In the present embodiment, during the cooling or dehumidification mode of operation, indoor air is drawn into the inside of the casing (2) through the air suction openings (9*a*). Thereafter, the indoor air flows through the air filter (9*c*) and then through the bell-mouse (6), is blown off radially outwardly from the impeller (4) and passes through the indoor heat exchanger (7). The air is cooled (dehumidified) by the indoor heat exchanger (7) and is blown off into the room through a blow-off opening (9*b*).

In the indoor heat exchanger (7), moisture contained in the indoor air condenses and, as a result, drain water is generated. The drain water falls in the form of drops from the indoor heat exchanger (7) and is collected in the drain pan (8). When a predetermined amount of drain water is accumulated in the drain pan (8), the drain pump (11) starts operating, and the drain water is discharged to outside the room from the internal drain pipe (12) via the external drain pipe (14).

When the drain water flows through the drain discharge pipe (15) which is a copper pipe, copper ions are eluted therefrom to the drain water. Therefore, the drain water, even when it contains various bacteria present in the air, is sterilized by the copper ions. Because of this, even in the case where drain water remains in the trap of the external drain pipe (14) with the drain pump (11) stopped, there are few possibilities that slime is generated by the growth of various bacteria, and the external drain pipe (14) is less apt to become clogged. In addition, even when the existing drain collective pipe is a resinous pipe, the generation of slime is inhibited also in the drain collective pipe because the drain water contains copper ions.

Effects of Embodiment

As explained above, in accordance with the present embodiment the drain discharge pipe (15) is formed from a copper pipe, thereby preventing the external drain pipe (14) from becoming clogged by slime. Therefore, problems, such as the occurrence of water leakage caused when the flow of drain water is obstructed and the generation of unpleasant odor by decay of accumulated substances, are prevented.

In addition, the arrangement that the external drain pipe (14) is formed from a copper pipe makes it possible to provide more inhibition of the aged deterioration of the external drain pipe (14) than when the external drain pipe (14) is formed from a resinous tube.

If the external drain pipe (14) is formed from a thick, hard synthetic resinous pipe, this produces the problem that it becomes difficult to carry out piping work. On the other hand, if the external drain pipe (14) is formed from a copper pipe as in the present embodiment, this offers the advantage of facilitating piping work. In other words, if the external drain pipe (14) is formed from a hard synthetic resinous pipe, this requires that short resinous pipes are connected together with a plurality of pipe joints such as elbows because drain piping has to be arranged so as to avoid beams extending under the roof for the case of ceiling embedded type air conditioning apparatuses. On the other hand, if the external drain pipe (14) is formed from a copper pipe, this makes it possible to bend the copper pipe itself on site. Accordingly, unlike the case where resinous pipes are employed, the use of pipe joints such as elbows become unnecessary, thereby facilitating piping work.

In addition, the present embodiment employs a force feed type pump in order to discharge drain water. As a result of such arrangement, water is less apt to be accumulated in the external drain pipe (14) even when there is created a trap therealong. Combined with the use of the external drain pipe (14) formed from a copper pipe, problems caused by the generation of slime are effectively prevented.

In conventional techniques, it is arranged such that drain water splashed up from the drain pan by the drain pump is made to flow by a head. Because of such arrangement, thick resinous pipes with a pipe diameter of 20-30 millimeters are generally employed in order to inhibit the occurrence of pressure loss in the drain pipe. On the other hand, the present invention employs the drain pump (11) which is a force feed type pump of high lift. This makes it possible to discharge drain water without any clogging even when the external drain pipe (14) with a small diameter of 12.7 millimeters is used. Furthermore, since it becomes possible to employ the external drain pipe (14) with such a small diameter, the rise in cost is held low even when using copper pipes. In addition, as the pipe diameter increases, the amount of drain water being accumulated likewise increases, and the bactericidal effect tends to fall. On the other hand, as the pipe diameter decreases, the amount of drain water being accumulated likewise decreases, and the bactericidal effect is enhanced.

OTHER EMBODIMENTS

With respect to the above-described embodiment, the present invention may be modified as follows.

For example, the present invention employs the drain pump (11) of the force feed type. However, the drain pump (11) may be of different types. In addition, in the above-described embodiment the internal diameter of the external drain pipe (14) is 12.7 millimeters. The size of the external drain pipe (14) is not limited to such a value and may be modified. However, as described above, it is possible to configure a relatively low-cost system capable of inhibition of the generation of slime without drain water clogging by making use of a combination of the drain pump (11) of the force feed type and a copper pipe with an internal diameter of 12.7 millimeters or less. Therefore, in the present invention this combination is especially preferable.

In addition, in the above-described embodiment the description has been made in terms of the example in which both the internal drain pipe (12) and the external drain pipe (14) are formed from copper pipes. However, it may be arranged such that the internal drain pipe (12) is formed from a resinous pipe while on the other hand the external drain pipe (14) is formed from a copper pipe. Alternatively, it may be arranged such that the internal drain pipe (12) is formed from a copper pipe while on the other hand the external drain pipe (14) is formed from a resinous pipe. Stated another way, it suffices if in the present invention at least any one of the internal drain pipe (12) and the external drain pipe (14) is formed from a copper pipe.

Additionally, the drain discharge pipe (15) may be formed from other than a copper pipe. For example, the drain discharge pipe (15) may be a resinous pipe including for example a copper wire section partially exposed at an internal surface of the resinous pipe. Alternatively, the drain discharge pipe (15) may be formed from a resinous pipe in which for example a copper wire section is separately disposed within an internal space of the resinous pipe. In other words, as the "cooper pipe" of the present invention, a resinous pipe which partially contains copper may be used.

Finally, the drain discharge pipe (15) (at least any one of the internal drain pipe (12) and the external drain pipe (14)) may be formed from an antibacterial metal pipe in addition to a copper pipe. In other words, the drain discharge pipe (15) may be formed from a metal pipe capable of eluting antibacterial metal ions upon contact with water.

INDUSTRIAL APPLICABILITY

As described above, the present invention is useful for a drain water discharge structure for an air conditioning apparatus configured so as to discharge drain water generated in an indoor heat exchanger disposed within a casing to outside the room through a drain discharge pipe made up of an internal drain pipe and an external drain pipe.

The invention claimed is:

1. A drain water discharge structure for an air conditioning apparatus configured so as to discharge drain water generated in an indoor heat exchanger disposed within a casing of said air conditioning apparatus to outside the room through a drain discharge pipe made up of an internal drain pipe and an external drain pipe, wherein at least said external drain pipe of said internal and external drain pipes is formed from a copper pipe, said external drain pipe has an internal diameter of 12.7 millimeters or less the drain water discharge structure comprises a drain pan disposed so as to receive drain water under said indoor heat exchanger, and a drain pump operable to send out drain water collected in said drain pan to said drain discharge pipe, and said drain pump is formed by a force feed type pump.

2. The drain water discharge structure of claim 1, wherein both said internal drain pipe and said external drain pipe are formed from copper pipes.

3. The drain water discharge structure of any one of claims 1-2, wherein said air conditioning apparatus is of the high installed type.

4. The drain water discharge structure of claim 1, wherein the internal drain discharge pipe has substantially U-shaped portions so that a drain water surface to air contact area is minimized when the drain water is trapped in the U-shaped potion.

* * * * *

UNITED STATES PATENT AND TRADEMARK OFFICE

CERTIFICATE OF CORRECTION

PATENT NO. : 7,392,821 B2
APPLICATION NO. : 10/526934
DATED : July 1, 2008
INVENTOR(S) : Haruo Nakata et al.

It is certified that error appears in the above-identified patent and that said Letters Patent is hereby corrected as shown below:

Title Page, item (54), in the title of the patent, please amend the title as follows:

Please delete "CONDITIONER" and change it to read --CONDITIONING APPARATUS-- so the title reads as follows:

--DRAIN WATER DISCHARGE STRUCTURE FOR AIR CONDITIONING APPARATUS--

Title Page, on page 2, (56) References Cited, under Foreign Patent Documents, please change: "JP 2002-021776 1/2002" to read --JP 2002-021778 1/2002--

Signed and Sealed this

Twenty-fourth Day of February, 2009

John Doll

JOHN DOLL
*Acting Director of the United States Patent and Trademark Office*

UNITED STATES PATENT AND TRADEMARK OFFICE

CERTIFICATE OF CORRECTION

PATENT NO. : 7,392,821 B2
APPLICATION NO. : 10/526934
DATED : July 1, 2008
INVENTOR(S) : Haruo Nakata et al.

It is certified that error appears in the above-identified patent and that said Letters Patent is hereby corrected as shown below:

Title Page, item (54) and Column 1, lines 1 and 2, in the title of the patent, please amend the title as follows:

Please delete "CONDITIONER" and change it to read --CONDITIONING APPARATUS-- so the title reads as follows:

--DRAIN WATER DISCHARGE STRUCTURE FOR AIR CONDITIONING APPARATUS--

Title Page, on page 2, (56) References Cited, under Foreign Patent Documents, please change: "JP 2002-021776 1/2002" to read --JP 2002-021778 1/2002--

This certificate supersedes the Certificate of Correction issued February 24, 2009.

Signed and Sealed this

Seventeenth Day of March, 2009

John Doll

JOHN DOLL
*Acting Director of the United States Patent and Trademark Office*